US007242378B2

(12) United States Patent
Okabe et al.

(10) Patent No.: US 7,242,378 B2
(45) Date of Patent: Jul. 10, 2007

(54) IMAGE DISPLAY DEVICE SUPPLIED WITH DIGITAL SIGNAL AND IMAGE DISPLAY METHOD

(75) Inventors: Masashi Okabe, Hyogo (JP); Masafumi Agari, Hyogo (JP); Hidetada Tokioka, Hyogo (JP); Ryuichi Hashido, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 653 days.

(21) Appl. No.: 10/838,248

(22) Filed: May 5, 2004

(65) Prior Publication Data

US 2004/0239696 A1 Dec. 2, 2004

(30) Foreign Application Priority Data

May 27, 2003 (JP) ..... 2003-149113
Feb. 26, 2004 (JP) ..... 2004-051640

(51) Int. Cl.
*G09G 3/30* (2006.01)

(52) U.S. Cl. ..... 345/77; 345/690; 345/82

(58) Field of Classification Search ..... 345/204–206, 345/690–693, 73–83; 315/169.3
See application file for complete search history.

(56) References Cited

U.S. PATENT DOCUMENTS 5,903,246 A * 5/1999 Dingwall ..... 345/82
6,670,773 B2 * 12/2003 Nakamura et al. ..... 315/169.3
2004/0263444 A1 * 12/2004 Kimura ..... 345/82

FOREIGN PATENT DOCUMENTS

JP 64-14631 1/1989
JP 7-13982 1/1995
JP 11-212493 6/1999
WO WO 02/075713 9/2002

OTHER PUBLICATIONS

Owaki et al., "Gray-Level Expression in Plasma Display", *Plasma Display*, 1983, pp. 154-163.
Yumoto et al., "Pixel-Driving Methods for Large-Sized Poly-Si AM-OLED Displays", *Asia Display/IDW'01*, 2001, pp. 1395-1398.
Bin, Guo, et al.; "Driving Method of Sub-frame and Current-ratio for PM-OLED", *Chinese J. of Liquid Crystals and Displays*, vol. 17, No. 3, p. 184, (Jun. 2002).

* cited by examiner

*Primary Examiner*—Amr A. Awad
*Assistant Examiner*—Tom V. Sheng
(74) *Attorney, Agent, or Firm*—Leydig, Voit & Mayer, Ltd.

(57) ABSTRACT

A current supply circuit includes a bit select circuit selectively providing even-numbered bits or odd-numbered bits of eight bit image data, and supplies a gray-scale current corresponding to the bits provided from the bit select circuit to a pixel. In a one-frame period, a time length for supplying a current corresponding to the even-numbered bits to the light-emitting element is set twice as large as a time length for supplying a current corresponding to the odd-numbered bits. By setting 16 levels of the gray-scale current for four bits, a current-time product of a current passing through the light-emitting element during the one-frame period can be controlled to 256 levels for eight bits. Thereby, an image display device provided at each of the pixels with the light-emitting element can reduce sizes of circuits generating the gray-scale current in accordance with a digital signal.

18 Claims, 13 Drawing Sheets

| DIGITAL INPUT SIGNAL | | CURRENT WAVEFORM OF LIGHT-EMITTING ELEMENT 110 OF CURRENT DRIVE TYPE (RELATIVE VALUE) | CURRENT X TIME S(m) |
|---|---|---|---|
| D(2m) | D(2m−1) | | |
| 0 | 0 | I(m) CURRENT 1 FRAME PERIOD PERIOD 1 PERIOD 2 TIME | 0 |
| 0 | 1 | I(m) CURRENT TIME T | I(m)·T |
| 1 | 0 | I(m) CURRENT TIME 2T | 2·I(m)·T |
| 1 | 1 | I(m) CURRENT TIME 2T T | 3·I(m)·T |

FIG.15

| BIT GROUP | DATA BIT | BIT-WEIGHTED CURRENT | CURRENT·TIME PRODUCT | |
|---|---|---|---|---|
| 1 | D(1) | I1 | I(1) × T | K=3 |
| | D(2) | I2 | I(1) × 2T | |
| | D(3) | I4 | I(1) × 4T | |
| ⋮ | ⋮ | | ⋮ | |
| m | D(3m−2) | $I2^{(3m-3)}$ | I(m) × T | I(m)=I(m−1)·$2^K$ |
| | D(3m−1) | $I2^{(3m-2)}$ | I(m) × 2T | |
| | D(3m) | $I2^{(3m-1)}$ | I(m) × 4T | |
| ⋮ | ⋮ | | ⋮ | |
| M | D(N−2) | $I2^{(N-3)}$ | I(M) × T | |
| | D(N−1) | $I2^{(N-2)}$ | I(M) × 2T | |
| | D(N) | $I2^{(N-1)}$ | I(M) × 4T | |

M=(N/K) N: TOTAL BIT NUMBER

FIG.16

| DIGITAL INPUT SIGNAL | | | CURRENT WAVEFORM OF LIGHT-EMITTING ELEMENT 110 OF CURRENT DRIVE TYPE (RELATIVE VALUE) | CURRENT X TIME S(m) |
|---|---|---|---|---|
| D(3m) | D(3m-1) | D(3m-2) | | |
| 0 | 0 | 0 | Im, CURRENT, 1 FRAME PERIOD, PERIOD 1, PERIOD 2, PERIOD 3, TIME | 0 |
| 0 | 0 | 1 | Im, CURRENT, TIME, T | I(m)·T |
| 0 | 1 | 0 | Im, CURRENT, TIME, 2T | 2·I(m)·T |
| 0 | 1 | 1 | Im, CURRENT, TIME, 2T, T | 3·I(m)·T |
| 1 | 0 | 0 | Im, CURRENT, TIME, 4T | 4·I(m)·T |
| 1 | 0 | 1 | Im, CURRENT, TIME, 4T, T | 5·I(m)·T |
| 1 | 1 | 0 | Im, CURRENT, TIME, 4T, 2T | 6·I(m)·T |
| 1 | 1 | 1 | Im, CURRENT, TIME, 4T, 2T, T | 7·I(m)·T |

IMAGE DISPLAY DEVICE SUPPLIED WITH DIGITAL SIGNAL AND IMAGE DISPLAY METHOD

BACKGROUND OF THE INVENTION

1. Field of the Invention

The present invention relates to an image display device and an image display method, and particularly to an image display device, which includes a light-emitting element of a current drive type in each of pixels, and executes gray-scale expression based on a digital signal.

2. Description of the Background Art

As an image display device of a flat-panel type, attention has been given to an image display device of a self-light-emitting type, in which each pixel is formed of a light-emitting element of a current drive type. The image display device of the self-light-emitting type has high visibility as well as high moving picture quality. A light-emitting diode (LED) is well known as a kind of light-emitting element of the current drive type.

The image display device includes a plurality of pixels, which are arranged in rows and columns, and are successively driven by dot-sequential scanning or line-sequential scanning to receive a display current. Each pixel keeps luminance corresponding to the display current, which was received for the above driving, until its next driving. The display current received by each pixel is usually formed of an analog current for achieving gray-scale expression. This analog current can be set to a level intermediate between maximum and minimum luminance levels of each light-emitting element so that each pixel can execute the gray-scale expression.

Therefore, the image display device provided with the light-emitting elements of the current drive type requires a current supply circuit, which generates the display current according to image data for exhibiting stepwise luminance at each pixel.

For example, Japanese Patent Laying-Open No. 11-212493 has disclosed a structure of an image display device, which provides image data formed of a digital signal of multiple bits. For supplying a display current (i.e., gray-scale current) for gray-scale expression, this structure includes a plurality of constant current supplies or sources connected in parallel as well as thin film transistors (TFTs), which are turned on/off in response to a plurality of bits forming the image data, and are interposed between the constant current supplies. A sum of currents selectively supplied from these constant current supplies is supplied to the light-emitting element.

In particular, a ratio of powers of 2 (e.g., 1:2:4:8) is set between output currents of the constant current supplies so that the gray-scale current can be controlled stepwise at equal intervals.

However, the current supply circuit described above suffers from a problem that a current supply circuit increases in size with the number of bits of the image data. Typically, the number of constant current supplies increases so that a footprint or area of the current supply circuits increases, and outer sizes of the image display device increase. Further, increase in circuit scale results in an increased manufacturing cost.

SUMMARY OF THE INVENTION

An object of the invention is to provide an image display device provided with light-emitting elements of the current drive type arranged in pixels, respectively, and particularly to provide an image display device and an image display method, which can reduce sizes of a circuit generating a gray-scale current according to a digital signal.

According to the invention, an image display device for performing gray-scale expression based on a digital signal of weighted N bits (N: even integer larger than three), includes a plurality of pixels arranged in rows and columns, a scanning portion for periodically selecting the plurality of pixels in a predetermined manner, and a gray-scale current generating circuit supplying a gray-scale current according to the digital signal to at least one of the pixels selected by the scanning portion. Each of pixels includes a light-emitting element of a current drive type exhibiting brightness according to the supplied current, and a pixel drive circuit for supplying the current to the light-emitting element of the current drive type. The pixel drive circuit receives the gray-scale current from the gray-scale current generating circuit during a predetermined period selected by the scanning portion, and supplies a current according to the gray-scale current received during the predetermined period to the light-emitting element of the current drive type. The gray-scale current generating circuit includes a bit select circuit receiving the digital signal, and selectively providing one of two sets of (N/2) bits respectively formed of even-numbered bits and odd-numbered bits among the N bits, and a current supply circuit controlling the gray-scale current at $2^{(N/2)}$ levels according to the (N/2) bits provided from the bit select circuit. In each of the pixels, the light-emitting element of the current drive type receives a current according to the gray-scale current according to the one of the two sets of (N/2) bits for a first time length, and then receives a current according to the gray-scale current according to the other of the two sets of (N/2) bits for a second time length. One of the first and second time lengths is twice as long as the other of the first and second time lengths in accordance with weighting of the digital signal.

According to another aspect of the invention, an image display device for performing gray-scale expression based on a digital signal of weighted N bits (N: integer exceeding three and represented by (K×M) where K and M are both integers larger than one), includes a plurality of pixels arranged in rows and columns, a scanning portion for periodically selecting the plurality of pixels in a predetermined manner, and a gray-scale current generating circuit supplying a gray-scale current according to the digital signal to at least one of the pixels selected by the scanning portion. Each of pixels includes a light-emitting element of a current drive type exhibiting brightness according to the supplied current, and a pixel drive circuit for supplying the current to the light-emitting element of the current drive type. The pixel drive circuit receives the gray-scale current from the gray-scale current generating circuit during a predetermined period selected by the scanning portion, and supplies a current according to the gray-scale current received during the predetermined period to the light-emitting element of the current drive type. The N bits are divided, in an order of weighting of the digital signal, into bit groups of M in number each including K bits. The gray-scale current generating circuit includes a bit select circuit receiving the digital signal, and successively providing, set by set, K sets of M-bit data each including one bit among K bits included in each of the M bit groups, and a current supply circuit controlling the gray-scale current at $2^{M}$ levels according to the M-bit data provided from the bit select circuit. In each pixel, the light-emitting element of the current drive type receives currents corresponding to the gray-scale currents corresponding to the K sets of M-bit data for first to Kth time lengths independent form each other, respectively. The first to Kth time lengths are set according to the weighting of the digital signal and in accordance with powers of 2.

According to the invention, an image display method of performing gray-scale expression based on a digital signal of weighted N bits (N: even integer larger than three) by an image display device provided at each of pixels with a light-emitting element of a current drive type exhibiting brightness corresponding to a supplied current. One frame period in each of the pixels is divided into first and second periods. In each of the pixels, the light-emitting element of the current drive type receives a current according to a gray-scale current according to one of two sets of (N/2) bits respectively formed even-numbered bits and odd-numbered bits of the digital signal for a first time length during the first period, and then receives the current according to the gray-scale current according to the other of the two sets of (N/2) bits for a second time length during the second period. In each of the first and second periods, control of the gray-scale current according to each of the two sets of (N/2) bits is performed in the same manner. One of the first and second time lengths is twice as long as the other of the first and second time lengths in accordance with weighting of the digital signal.

According to the invention, an image display method of performing gray-scale expression based on a digital signal of weighted N bits (N: integer exceeding three and represented by (K×M) where K and M are both integers larger than one), by an image display device provided at each of pixels with a light-emitting element of a current drive type exhibiting brightness corresponding to a supplied current. One frame period in each of the pixels is divided into first to Kth periods. The N bits is divided, in an order of weighting of the digital signal, into bit groups of M in number each including K bits. The light-emitting element of the current drive type in each pixel receives currents each corresponding to a gray-scale current corresponding to one of K sets of M bits including one bit successively selected from K bits included in each of the bit groups for first to Kth independent time lengths in the first to Kth periods, respectively. In each of the first to Kth periods, control of the gray-scale current according to the M bits is performed in the same manner. The first to Kth time lengths are set in accordance with powers of 2 according to the weighting of the digital signal.

In the image display device and the image display method according to the invention, the light-emitting element of the current drive type in each pixel can be controlled owing to the setting ($2^{(N/2)}$-level setting) of the gray-scale current for (N/2) bits such that a product of the current and the time of the passing current during a one-frame period can be controlled at $2^N$ levels corresponding to N bits. Therefore, the number of parts of the gray-scale current generating circuit can be reduced, and the size and manufacturing cost of the image display device can be reduced.

In the case where the one-frame period is divided into K (K: integer larger than of the current passing through the light-emitting element of the current drive type in each pixel during the one-frame period can be controlled at $2^N$ levels corresponding to N bits. Therefore, the number of parts of the gray-scale current generating circuit can be significantly reduced, and the size and manufacturing cost of the image display device can be further reduced.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 15 illustrates gray-scale current setting according to a fourth embodiment.

FIG. 16 illustrates current control in each bit group according to the fourth embodiment.

DESCRIPTION OF THE PREFERRED EMBODIMENTS

Embodiments of the invention will now be described with reference to the drawings. In the following description, the same or corresponding portions bear the same reference numbers.

First Embodiment

Figure 1:
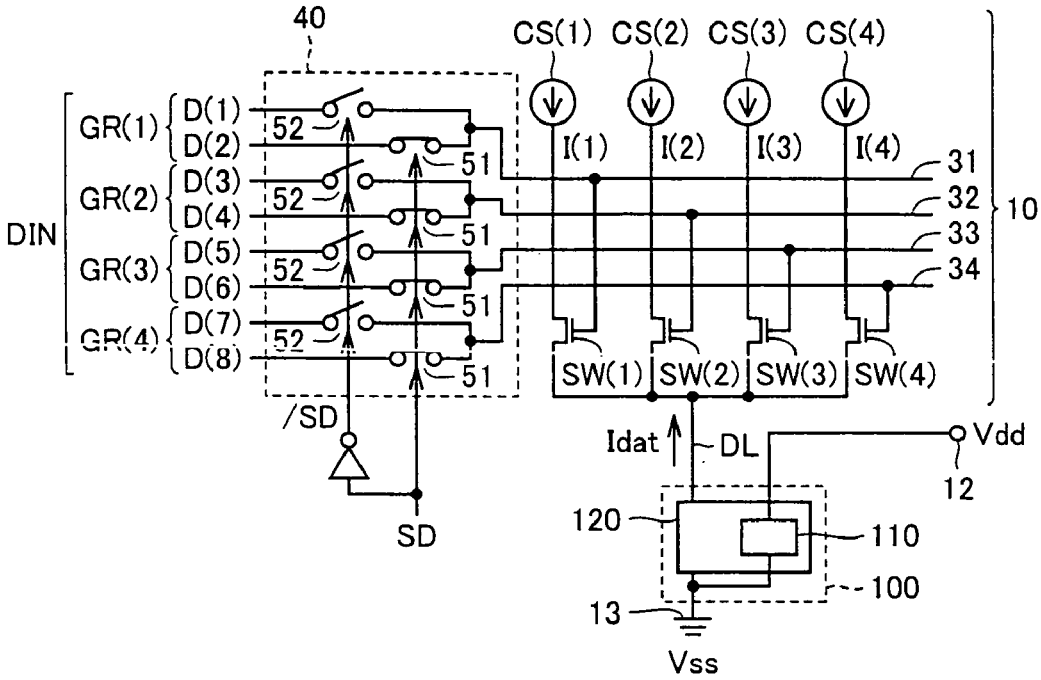
FIG. 1 illustrates a structure of a current supply circuit according to a first embodiment for generating a gray-scale current in an image display device according to the invention.

FIG. 1 illustrates a structure of a current supply circuit according to a first embodiment for generating a gray-scale current in an image display device according to the invention.

Referring to FIG. 1, a current supply circuit 10 according to the first embodiment supplies a current (i.e., gray-scale current) Idat corresponding to image data Din, which is a digital signal of multiple bits, to a pixel 100 via a data line DL.

For specifically illustrating a structure of the current supply circuit, the first embodiment is representatively described in connection with one pixel selected from the plurality of pixels 100 as a target, to which gray-scale current Idat is supplied.

In the following description, it is assumed that image data DIN is a digital signal of 8 bits. Thus, display luminance of each pixel 100 is controlled at $2^8$ (=256) levels according to data bits D(1)-D(8) each set to "1" or "0".

Predetermined weighting is effected on image data DIN such that data bit D(1) corresponds to the Least Significant Bit (LSB), and data bit D(8) corresponds to the Most Significant Bit (MSB). Thus, bit-weighted currents I1, I2, I4, I8, I16, I32, I64 and I128 correspond to data bits D(1), D(2), D(3), D(4), D(5), D(6), D(7) and D(8), and a sum of these bit-weighted currents represents the gray-scale current at the 256 levels from I0-I255. It is now assumed that a current Ik (k: integer) is k times larger than a current I. Thus, relationships of (I255-I254=I254-I253= . . . =I2-I1=I1=I) and (I0=0) are present.

Pixel 100 includes a light-emitting element 110 of a current drive type electrically connected between a power supply node 12 and a power supply node 13, and a pixel drive circuit 120 supplying a display current to light-emitting element 110 of the current drive type. Power supply nodes 12 and 13 supply a power supply voltage Vdd and a predetermined Vss (typically, a ground voltage), respectively. Light-emitting element 110 of the current drive type is formed of an EL (Electro Luminescence) element or an LED (Light-Emitting Diode). Light-emitting element 110 of the current drive type emits the light with brightness (luminance) according to the display current supplied thereto.

Pixel drive circuit 120 receives gray-scale current Idat from current supply circuit 10 during a selection period of the corresponding pixel 100, and supplies the display current corresponding to gray-scale current Idat supplied during the selection period to light-emitting element 110 of the current drive type. Light-emitting element 110 of the current drive type emits the light with the luminance corresponding to the display current.

Data bits D(1)-D(8) are divided into bit groups GR(1)-GR(4) each formed of neighboring two bits. Each of bit groups GR (generally representing GR(1)-GR(4)) is formed of an odd-numbered data bit and an even-numbered data bit, of which bit-weighted currents exhibit a ratio of 1:2. More specifically, bit group GR(1) is formed of odd-numbered data bit D(1) and even-numbered data bit D(2), and bit group GR(2) is formed of odd-numbered data bit D(3) and even-numbered data bit D(4). Bit group GR(3) is formed of odd-numbered data bit D(5) and even-numbered data bit D(6), and bit group GR(4) is formed of odd-numbered data bit D(7) and even-numbered data bit D(8).

Current supply circuit 10 includes a bit select circuit 40, and also includes constant current supplies CS(1)-CS(4), signal lines 31-34 and switching elements SW(1)-SW(4), which are provided corresponding to bit groups GR(1)-GR(4), respectively.

Bit line select circuit 40 has switching elements 51 and 52 provided for each bit group GR. In each bit group GR, switching element 51 is arranged between a node supplied with a corresponding even-numbered data bit and corresponding one of signal lines 31-34, and switching element 52 is arranged between a node supplied with a corresponding odd-numbered data bit and the corresponding signal line. Switching elements 51 and 52 provided for each bit group are formed of, e.g., n-type TFTs, and are complementarily turned on/off in response to a control signal SD.

As described above, bit select circuit 40 transmits selected one of a set of even numbered data bits D(2), D(4), D(6) and D(8) and a set of odd-numbered data bits D(1), D(3), and D(5), to signal lines 31-34, in accordance with control signal SD.

Output currents I(1)-I(4) of constant current supplies CS(1)-CS(4) are set in accordance with ratios of powers of four. More specifically, there is a relationship of (I(1)=I1, I(2)=I4, I(3)=I16 and I(4)=I64).

Switching elements SW(1)-SW(4) are arranged between constant current supplies CS(1)-CS(4) and data line DL, and are turned on/off in response to voltages on signal lines 31-34, respectively. Switching elements SW(1)-SW(4) are typically formed of n-type TFTs having gates connected to signal lines 31-34, respectively.

Since constant current supplies CS(1)-CS(4) are connected in parallel to data line DL via switching elements SW(1)-SW(4), gray-scale current Idat supplied from current supply circuit 10 is formed of a sum of currents selected from output currents I(1)-I(4) of constant current supplies CS(1)-CS(4).

Current supply circuit 10 according to the first embodiment have structures corresponding to bit groups GR(1)-GR(4), respectively, and these structures are similar to each other. Therefore, an operation of the structure corresponding to one bit group GR will now be described.

Figure 2:
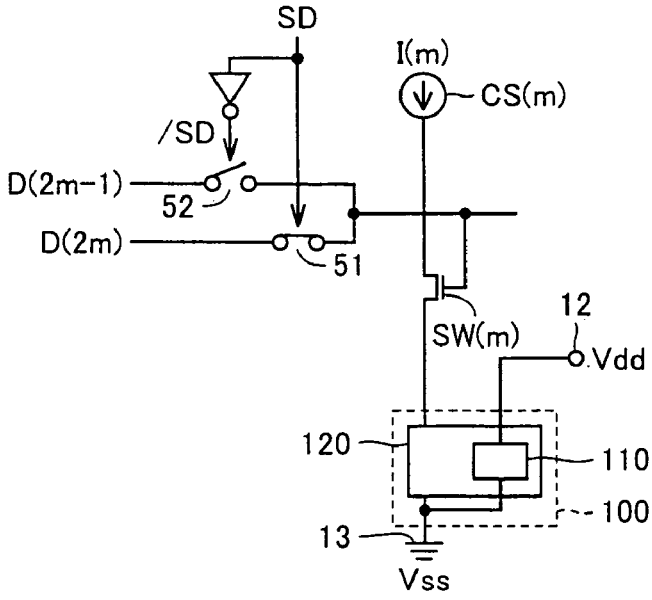
FIG. 2 illustrates an operation of a current supply circuit shown in FIG. 1.

FIG. 2 shows a structure of a portion in current supply circuit 10 shown in FIG. 1, and particularly shows the structure corresponding to the mth (m: 1-4) bit group.

Referring to FIG. 2, when switching element 51 is on, even-numbered data bit D(2m) is transmitted to the corresponding signal line, and switching element SW(m) is turned on/off in accordance with data bit D(2m). Therefore, when data bit D(2m) is "1", output current I(m) is transmitted to data line DL. When data bit D(2m) is "0", output current I(m) is not transmitted to data line DL, When switching element 52 is on, odd-numbered data bit D(2m−1) is transmitted to the corresponding signal line, and switching element SW(m) is turned on/off in accordance with data bit D(2m−1). Therefore, when data bit D(2m−1) is "1", output current I(m) is transmitted to data line DL. When data bit D(2m−1) is "0", output current I(m) is not transmitted to data line DL.

Figures 3, 4:
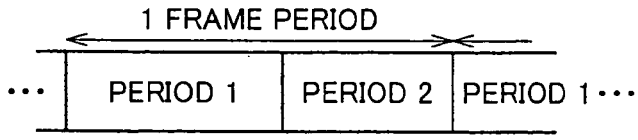
FIG. 3 illustrates a structure of a one-frame period in each pixel of the image display device according to the invention.
FIG. 4 illustrates current control in each bit group by the current supply circuit according to the first embodiment.

FIG. 3 illustrates a structure of a one-frame period in each pixel of the image display device according to the invention, and FIG. 4 illustrates current control in each bit group by the current supply circuit according to the first embodiment.

According to the image display device of the invention, as illustrated in FIG. 3, the one-frame period of each pixel is divided into a period 1 for performing display according to the even-numbered bits and a period 2 for performing display according to the odd-numbered bits. In period 1, even-numbered bits D(2), D(4), D(6) and D(8) are transmitted to signal lines 31-34, respectively, and for this transmission, control signal SD is set to a logically high level (which will be referred to as an "H-level" hereinafter) for turning on each switching element 51. In period 2, odd-numbered bits D(1), D(3), D(5) and D(7) are transmitted to signal lines 31-34, respectively, and for such transmission, control signal SD is set to a logically low level (which will be referred to as an "L-level" hereinafter) for turning on each switching element 52.

As illustrated in FIG. 4, therefore, the device operates to execute or stop the supply of output current I(m) according to even-numbered data bit D(2m) during period 1, and operates to execute or stop the supply of output current I(m) according to odd-numbered data bit D(2m−1) during period 2.

The ratio of 2:1 is present between weighted currents of even- and odd-numbered data bits D(2m) and D(2m−1) as described above. Correspondingly, a light emission time length, i.e., a length of the period of current supply to light-emitting element 110 of the current drive type during period 2 can be twice as large as a light emission time length T during period 1, and thus is equal to 2T.

Consequently, a product S(m) (which will be referred as "current-time product") of the currents and times of the currents passing through the current drive element within the one-frame period can be expressed by the following formula (1):

$$S(m)=I(m)\cdot D(2m)\cdot 2T+I(m)\cdot D(2m-1)\cdot T \quad (1)$$

Therefore, current-time product S(m) is set to four levels of 0, I(m)·T, 2·I(m)·T and 3·I(m)·T in response to combinations of the even- and odd-numbered data bits, i.e., (D(2m), D(2m−1)=(0, 0), (0, 1), (1, 0) and (1, 1)), respectively. Thus, current-time product S(m) at four levels corresponding to 2 bits can be obtained by using single constant current supply CS(m).

Control method similar to the above can be applied to each bit group GR. In period 1, therefore, switching elements SW(1)-SW(4) are controlled in response to D(2), D(4), D(6) and D(8), respectively, and a sum of the output currents of the constant current supplies, which correspond to the data bits of "1", is supplied to pixel 100 as gray-scale current Idat through data line DL. For example, in the case of ((D(8), D(6), D(4), D(2))=(0, 1, 0, 1)), a current I17, which is a sum of output current I(3)(=I16) of constant current supply CS(3) and output current I(1)(=I1) of constant current supply CS(1), is output as gray-scale current Idat. In period 2, gray-scale current Idat corresponding to odd-numbered data bits D(1), D(3), D(5) and D(7) is supplied to pixel 100.

In accordance with the ratio of powers of four, as already described, output currents I(1), 1(2), I(3) and I(4) are set to I1, I4, 116 and I64, respectively. Therefore, current-time product S of the current passing through light-emitting element 110 of the current drive type during a period of one frame is expressed by the following formula (2):

$$S=\{(I64\cdot D(8)+I16\cdot D(6)+I4\cdot D(4)+I1\cdot D(2))\cdot 2T\}+\{(I64\cdot D(7)+I16\cdot D(5)+I4\cdot D(3)+I1\cdot D(1))\cdot T\} \quad (2)$$

Data bits D(1)-D(8) are selectively set to "0" and "1" so that the current-time product S can be set to 256 levels of 0-255·T·I for the image in response to (D(8), D(7), D(6), D(5), D(4), D(3), D(2), D(1))(=(0, 0, 0, 0, 0, 0, 0, 0)-(1, 1, 1, 1, 1, 1, 1, 1)).

The human being can visually sense, as a difference in brightness, (luminance) a difference in current-time product of the current passing through the light-emitting element of the current drive type within the one-frame period of the image display. Therefore, by setting the current-time product to 256 levels, the display of 256 gray-levels can be performed without setting the gray-scale current itself, which is supplied from the current supply circuit, to 256 levels.

Thus, 8-bits gray-scale expression can be executed by four constant current supplies CS(1)-CS(4), four switching elements SW(1)-SW(4) and four signal lines 31-34, which are half the number of bits of image data DIN.

Figure 5:
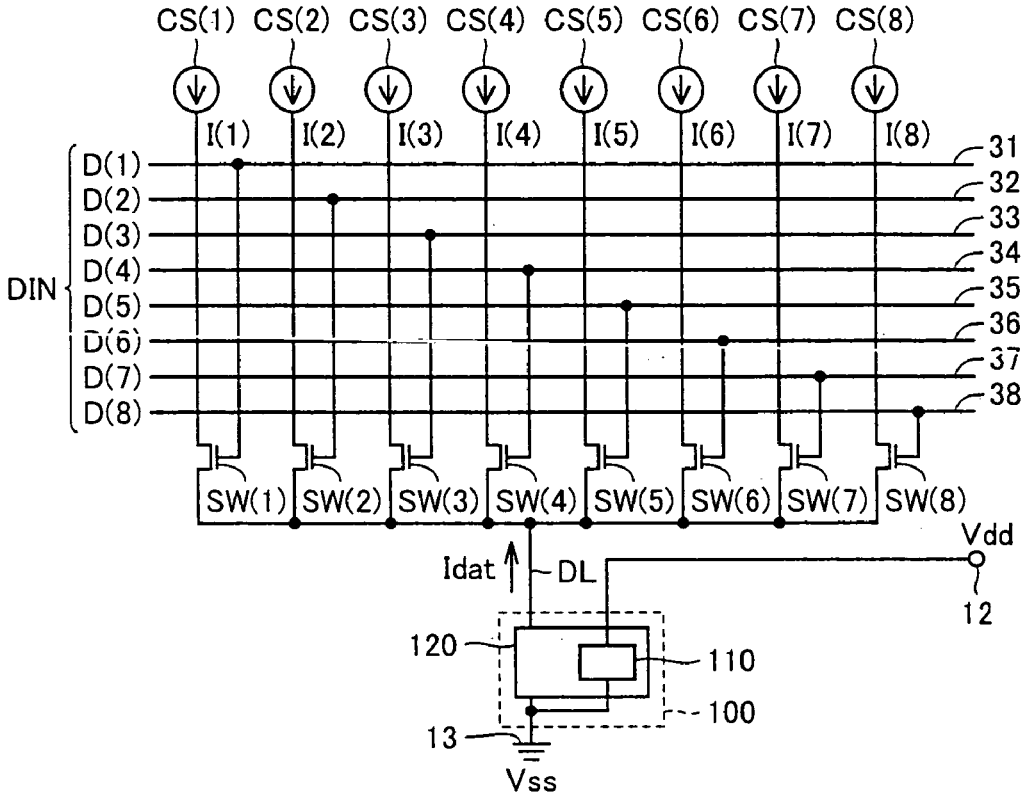
FIG. 5 illustrates a structure of a current supply circuit of an example for comparison.

FIG. 5 shows, as an example for comparison, a structure of a current supply circuit required in an image display device, which sets the passing current of the light-emitting element of the current drive type to a constant value throughout the one-frame period.

The current supply circuit shown in FIG. 5 requires eight constant supplies CS(1)-CS(8), eight signal lines 31-38 and eight switching elements SW(1)-SW(8), which are equal in number to the bits for generating the gray-scale current corresponding to all the bits of the image data. Consequently, the circuit scale remarkably increases with the number of bits.

According to the current supply circuit of the invention, as described above, the number of circuit parts generating the gray-scale current can be smaller than that of the circuit parts in FIG. 5 when both the circuits handle the image data of the same number of bits, i.e., the same number of gray-levels. Consequently, the circuit according to the invention can reduce a footprint or area, and can reduce outer sizes of the image display device. Further, the reduction in number of the parts can reduce a manufacturing cost.

Second Embodiment

In a second embodiment, a structure example of active matrix type image display device generating gray-scale current by the current supply circuit according to the first embodiment is explained.

Figure 6:
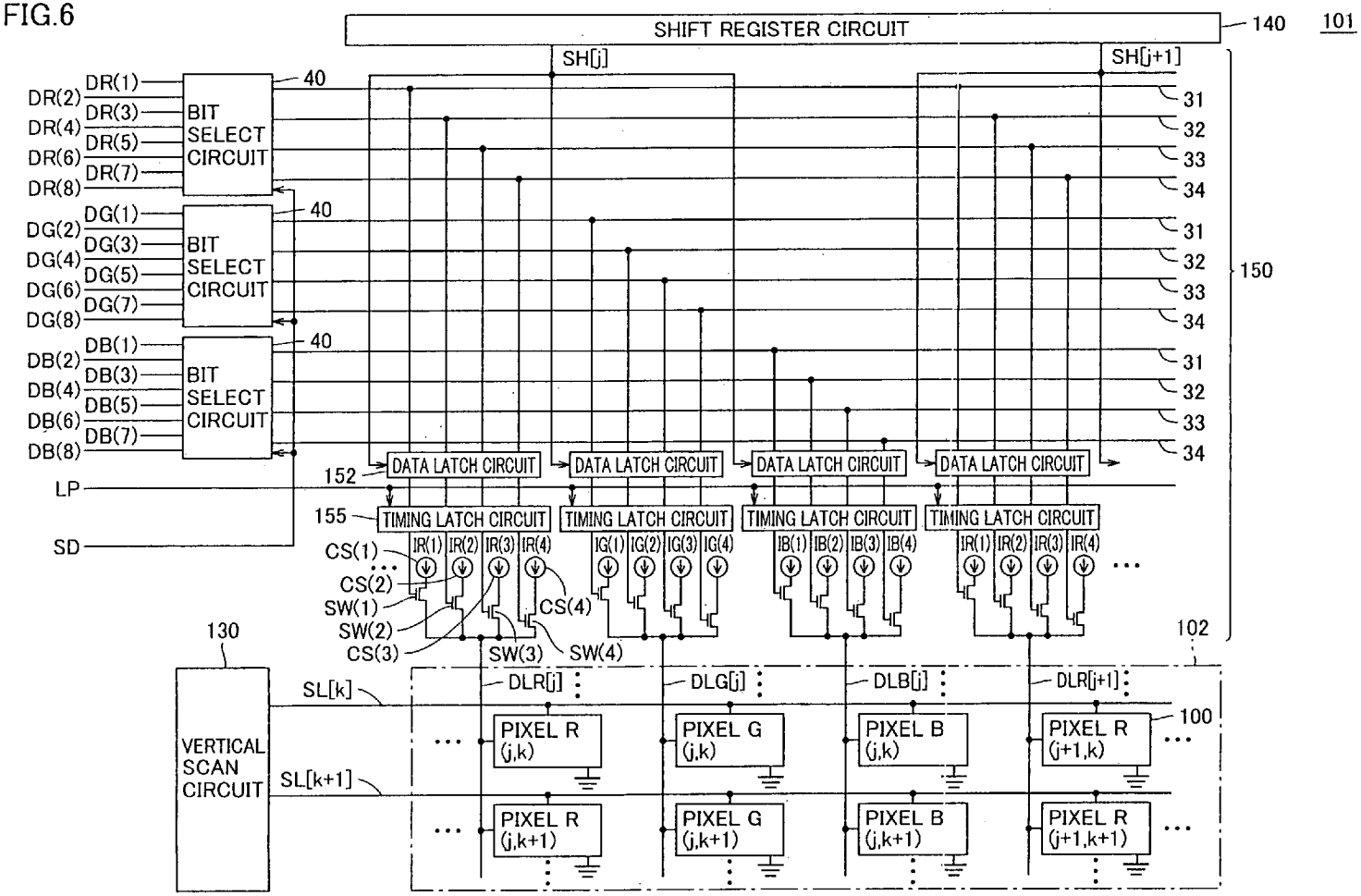
FIG. 6 is a block diagram illustrating a structure of an image display device according to a second embodiment.

Referring to FIG. 6, an image display device 101 according to the second embodiment includes a pixel array 102 having a plurality of pixels 100 arranged in rows and columns, a vertical scanning circuit 130, a shift register circuit 140 and a gray-scale current generating circuit 150. In each pixel row, three pixels 100 form one color display unit, and perform the display in R (Red), G (Green) and B (Blue), respectively, so that pixel array 102 displays a color image.

In pixel array 102, scan lines SL are arranged corresponding to rows of pixels 100, respectively. These rows will be merely referred to as "pixel rows" hereinafter. FIG. 6 representatively shows scan lines SL[k] (k: natural number) and SL[k+1] in kth and (k+1)th rows.

In response to a clock representing a predetermined scanning period, vertical scanning circuit 130 activates scan line SL corresponding to the selected row to attain the selected state (H-level), and deactivates other scan lines SL to attain the unselected state (L-level). Therefore, scan lines SL are successively activated to attain the selected state with predetermined cycles.

Data lines are arranged corresponding to columns of pixels 100, respectively. These rows will be merely referred to as "pixel columns" hereinafter. In FIG. 6, DLR, DLG and DLB indicate data lines corresponding to R, G and B, respectively. FIG. 6 representatively shows data lines DLR[j], DLG[j] and DLB[j] corresponding to a jth (j: natural number) color display unit as well as a data line DLR[j+1] corresponding to an R display pixel in a (j+1) the display unit. In the following description, "data line DL" or "data lines DL" are likewise used for generally representing the data line(s) without distinction of color.

Image data DRIN formed of data bits DR(1)-DR(8) indicates display brightness (luminance) of the pixel for display in red (R). Likewise, image data DGIN formed of data bits DG(1)-DG(8) indicates display brightness of the pixel for display in green (G), and image data DBIN formed of data bits DB(1)-DB(8) indicates display brightness of the pixel for display in blue (B).

Based on the clock signal for successively selecting the pixel columns, shift register circuit 140 produces select signals SH for successively selecting the respective color display units each formed of three pixel columns. For example, SH[j] and SH[j+1] indicate the select signals corresponding to the color display units in the jth and (j+1)th positions in FIG. 6.

Gray-scale current generating circuit 150 includes a bit select circuit 40 and signal lines 31-34, which are provided corresponding to each of image data DRIN, DGIN and DBIN for display in red, green and blue. Gray-scale current generating circuit 150 has a data latch circuit 152, a timing latch circuit 155, constant current supplies CS(1)-CS(4) and switching elements SW(1)-SW(4), which are provided for each data line DL.

Data latch circuit 152 takes in and holds the data bits on corresponding signal lines 31-34 in response to select signal SH sent from shift register circuit 140. According to the timing responsive to a latch pulse LP, timing latch circuit 155 transmits the data bits held by data latch circuit 152 to gates of switching elements SW(1)-SW(4), and holds the voltages on these gates.

Operations of each bit select circuit 40 and switching elements SW(1)-SW(4) are similar to those already described with reference to the first embodiment, and therefore description thereof is not repeated. In FIG. 6, IR(1)-IR(4) indicate the output currents of the constant current supplies for R display, IG(1)-IG(4) indicate the output currents of the constant current supplies for G display, and IB(1)-IB(4) indicate the output currents of the constant current supplies for B display, respectively. In the structure corresponding to each data line DL, however, the output currents of constant current supplies CS(1)-CS(4) are set in accordance with ratios of powers of four, similarly to currents I(1)-I(4) in the first embodiment.

Although gray-scale current generating circuit 150 includes data latch circuits 152 and timing latch circuits 155 for executing the supply of gray-scale currents for each pixel row in accordance with line-sequential scanning, but supplies the gray-scale current to each data line DL by the structure similar to that of the current supply circuit according to the first embodiment.

Figure 7:
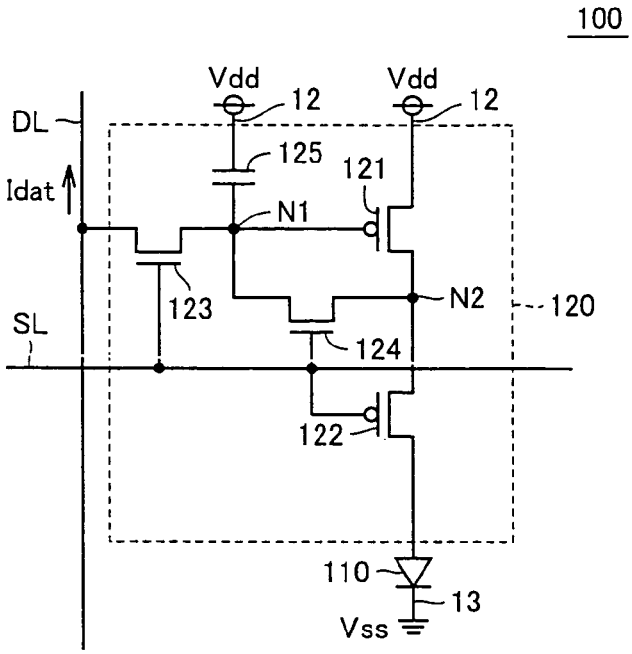
FIG. 7 is a circuit diagram showing a structure example of a pixel illustrated in FIG. 6.

FIG. 7 is a circuit diagram showing a structure example of the pixel shown in FIG. 6.

FIG. 7 shows, by way of example, a pixel circuit structure of a current program type provided with an Organic Light-Emitting Diode (OLED) serving as light-emitting element 110 of the current drive type. The pixel of the current program type is disclosed, e.g., in "Pixel-Driving Methods for large-Sized Poly-Si AM-OLED Displays", Akira Yumoto et al., Asia Display/IDW'01 (2001) pp. 1395-1398.

Referring to FIG. 7, pixel 100 includes pixel drive circuit 120 for supplying a display current corresponding to gray-scale current Idat to organic light-emitting diode 110. Pixel drive circuit 120 includes p-type TFTs 121 and 122, n-type TFTs 123 and 124, and a capacitor 125.

A source and a drain of p-type TFT 121 are connected to a power supply node 12 and a node N2, respectively. p-type TFT 122 is connected between node N2 and light-emitting element 110 of the current drive type. Organic light-emitting diode 110 is connected between p-type TFT 122 and power supply node 13 corresponding to a common electrode. Thus, FIG. 7 shows a "cathode common structure", in which a cathode of organic light-emitting diode 110 is connected to the common electrode.

n-type TFT 123 is electrically connected between corresponding data line DL and a node N1. n-type TFT 124 is electrically connected between nodes N1 and N2.

A gate of p-type TFT 121 is connected to node N1, and gates of p-type TFT 122 and n-type TFTs 123 and 124 are connected to corresponding scan line SL. Capacitor 125 is connected between node NI and power supply node 12, and holds a voltage on node N1, i.e., a gate-source voltage, which may be merely referred to as a "gate voltage" hereinafter, of p-type TFT 121.

A program operation and a light emitting operation will now be described.

In the program operation, corresponding scan line SL is activated to attain the selected state (H-level). Thereby, n-type TFTs 123 and 124 are turned on to form a current path extending from power supply node 12 (power supply voltage Vdd) through p-type TFT 121 and n-type TFTs 123 and 124 to data line DL. Thereby, gray-scale current Idat flows through the path extending from pixel drive circuit 120 via data line DL to gray-scale current generating circuit 150.

In this operation, n-type TFT 124 electrically connects the drain and gate of p-type TFT 121 so that capacitor 125 holds the gate voltage, which appears when p-type TFT 121 drives gray-scale current Idat. In this manner, pixel drive circuit 120 programs gray-scale current Idat according to the display luminance in the program period, during which scan line SL is in the selected state.

Thereafter, the scanning target changes, and corresponding scan line SL is deactivated to attain the unselected state (L-level). Thereby, n-type TFTs 123 and 124 are turned off, and p-type TFT 122 is turned on. Thereby, a current path extending from power supply node 12 (power supply voltage Vdd) to common electrode (power supply node 13: predetermined voltage Vss) through p-type TFTs 121 and 122 as well as organic light-emitting diode 110 is formed in pixel 100. An amount of the current flowing through this current path depends on the gate voltage of p-type TFT 121, i.e., the current drive element.

Therefore, in the light emission period, during which scan line SL is set to the unselected state, a current corresponding to gray-scale current Idat, which was programmed in the program period, passes through the light-emitting diode 110. Consequently, even during the inactive period of scan line SL, organic light-emitting diode 110 can continuously exhibits the brightness (luminance) according to gray-scale current Idat.

Figure 8:
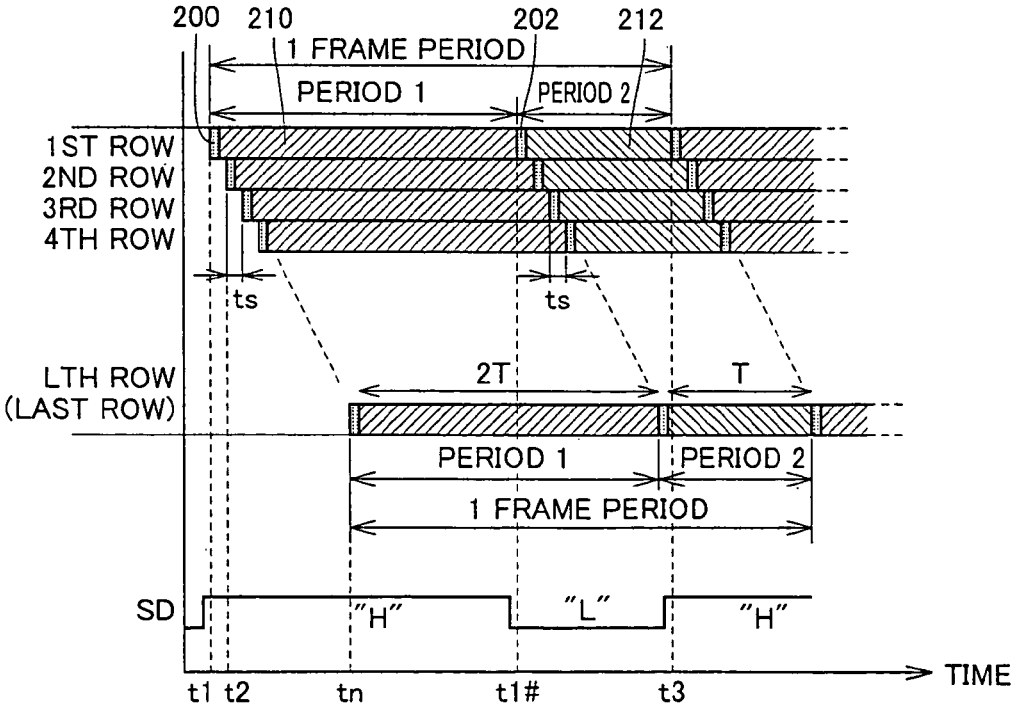
FIG. 8 conceptually illustrates drive timing of pixels in the image display device according to the second embodiment.

FIG. 8 conceptually illustrates drive timing of the pixels in the image display device according to the second embodiment.

In the structure according to the second embodiment, as illustrated in FIG. 8, the one-frame period as well as periods 1 and 2, which are prepared by dividing the one-frame period, are defined for each pixel row, and thus independently of those for other pixel rows.

In period 1, vertical scanning circuit 130 successively selects 1st to Lth (last) rows at time intervals of ts. For example, scan line SL[1] corresponding to the first row attains the selected state (H-level) at time t1, and will kept it for a predetermined time. Corresponding to this, a program period 200 is provided for the first row.

At a time t2 after a time length of ts from time t1, the second row is selected. At time t2, it is necessary that program period 200 of the first row has already expired. For a predetermined period from time t2, scan line SL[2] is set to the selected state so that program period 200 of the second row is provided. Thereafter, the third to Lth (last) rows are successively selected to provide program periods 200 of the respective rows. The scan line of the Lth (last) row is set to the selected state for a predetermined period after time tn. In each program period 200, programming of gray-scale currents Idat for pixel drive circuits 120 in pixels 100 for one row are executed in parallel by using respective data lines DL.

Control signal SD is set to the H-level such that program periods 200 for the respective pixel rows during period 1 may be covered. Thereby, gray-scale current Idat programmed in each program period 200 is set to the level corresponding to the even-numbered data bits. For example, control signal SD is set to the H- and L-levels corresponding to periods 1 and 2 for the first row.

Time ts corresponds to a scanning time of one row. In the image display device according to the second embodiment, scanning time ts is set to or below a value obtained by dividing a sum of a program period 202 and a light emission period 212 in period 2, which will be described below, by the number (i.e., L) of the pixel rows.

In each pixel row, when program period 200 expires and corresponding scan line SL attains the unselected state, a light emission period 210 starts, and a current according to gray-scale current Idat programmed during program period 200 is supplied to light-emitting element 110 of the current drive type. In light emission period 210, thereby, light-emitting element 110 of the current drive type emits the light with brightness according to gray-scale current Idat, which was programmed during program period 200.

In each pixel row, period 2 starts in accordance with timing ensuring light emission period 210 of a time length 2T, and corresponding scan line SL is set to the selected state for a predetermined period again so that program period 202 is provided. For example, corresponding to the first row, scan line SL[1] changes from the unselected state to the selected state again at a time t1# after a time of 2T elapses from the end of program period 200. The second to Lth (last) rows are successively selected to provide program periods 202 upon every elapsing of scanning time ts.

For covering program period 202 in each pixel row within period 2, control signal SD is set to the L-level. Thereby, gray-scale current Idat programmed in each program period 202 is set to the level according to the odd-numbered data bit.

In each pixel row, when program period 202 ends and corresponding scan line SL is set to the unselected state, light emission period 212 starts, and a current according to gray-scale current Idat programmed during program period 202 is supplied to light-emitting element 110 of the current drive type. During light emission period 212, thereby, light-emitting element 110 of the current drive type emits the light with luminance corresponding to gray-scale current Idat programmed during program period 202.

In each pixel row, the one-frame period then ends in accordance with timing ensuring light emission period 212 of time T (a half of time 2T), and period 1 of a next one-frame period starts. In response to this, corresponding scan line SL is set to the selected state for a predetermined period again, and the next program period is provided.

Corresponding to, e.g., the first row, scan line SL[1] changes from the unselected state to the selected state again at a time t3 after time T from the end of program period 202. Further, control signal SD attains the H-level again for producing gray-scale current Idat corresponding to the even-numbered data bit. At and after time t3, the second to Lth (last) rows are successively selected in a similar manner at intervals of scanning time ts so that next frame periods start.

By driving the pixels in the manner illustrated in FIG. 8, light emission period 210 corresponding to the even-numbered bit and light emission period 212 corresponding to the odd-numbered bit, which are independent from each other, are provided within the one-frame period for each pixel, and a ratio between light emission periods 210 and 212 can be set to 2:1 in accordance with the bit-weighting.

Consequently, the gray-scale expression corresponding to the number of bits of the image data can be performed by the gray-scale current provided from the current supply circuit including the constant current supplies, signal lines and switching elements, which are half the number of bits of the image data. Therefore, the image display device according to the second embodiment can reduce the number of parts of the gray-scale current generating circuit 150, and thereby can reduce the sizes and manufacturing cost.

Third Embodiment

Figure 9:
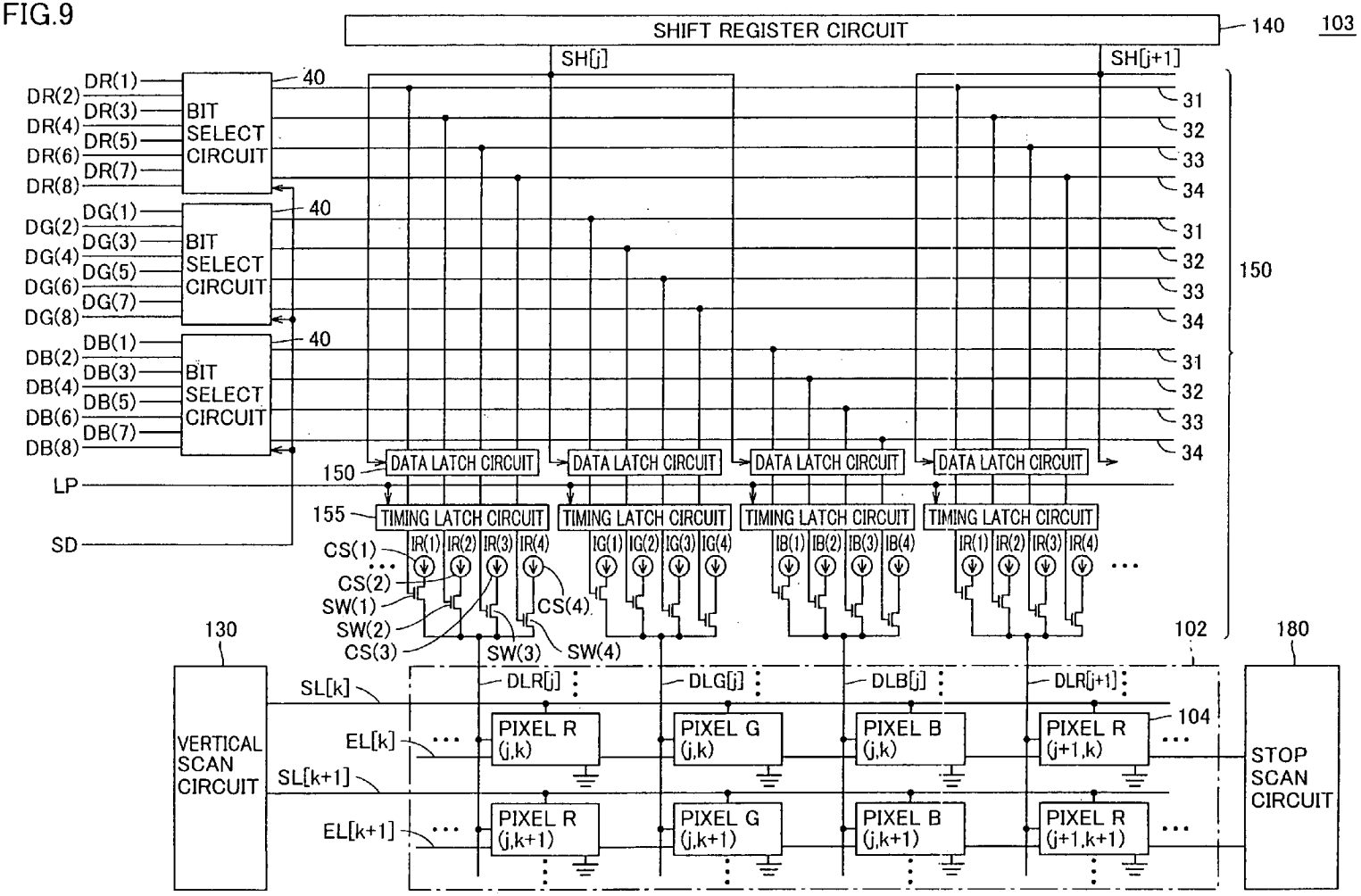
FIG. 9 is a block diagram illustrating a structure of an image display device according to a third embodiment.

Referring to FIG. 9, an image display device 103 according to a third embodiment differs from an image display device 101 shown in FIG. 6 in that a stop scan circuit 180 is further employed for forcedly stopping the supply of current to light-emitting elements 110 of the current drive type in each pixel.

A structure example shown in FIG. 9 further includes a stop scan line EL for each pixel row. FIG. 9 representatively shows stop scan lines EL[k] (k: natural number) and EL[k+1] arranged in Kth and (k+1)th rows, respectively.

Stop scan circuit 180 instructs stop of the current supply to light-emitting elements 110 of the current drive type for each pixel row on a row-by-row basis by controlling the voltage on each stop scan line EL. In view of this, pixel array 102 is provided with pixels 104, which have a function of forcedly stopping the supply of current, in place of pixels 100. Structures of the other portions are the same as those of image display device 101 shown in FIG. 6, and therefore description thereof is not repeated.

Figure 10:
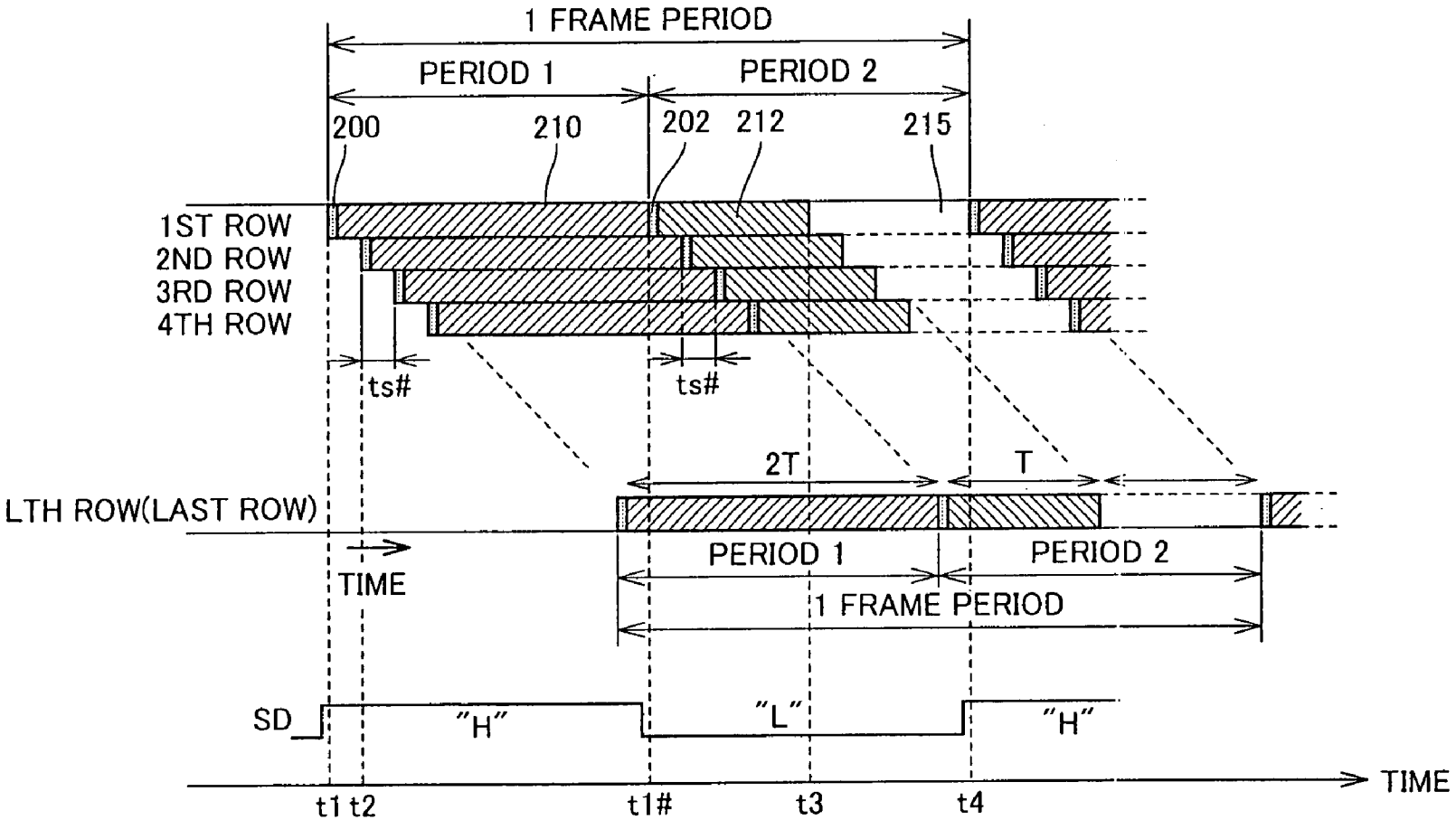
FIG. 10 conceptually illustrates drive timing of pixels in the image display device according to the third embodiment.

FIG. 10 conceptually illustrates drive timing of the pixels in the image display device according to the third embodiment.

In the image display device according to the third embodiment, as illustrated in FIG. 10, the one-frame period as well as periods 1 and 2, into which the one-frame period is divided, are defined for each row independently from those for the other rows.

The image display device according to the third embodiment differs from the image display device according to the second embodiment in that at least one of periods 1 and 2 in each one-frame period includes a light emission forced-stop period 215 for forcedly stopping the light emission. In the following description, it is assumed that light emission forced-stop period 215 is provided in the latter half of period 2 having a short light emission period. For example, in the first row, light emission forced-stop period 215 is located between time t3 ensuring light emission period 212 of time T and a time t4 of start of the next one-frame period.

Program periods 200 and 202, light emission periods 210 and 212, and control signal SD are set similarly to those already described with reference to FIG. 8. Thus, in the third embodiment, a ratio of 2:1 is set between light emission period 210 corresponding to the even-numbered data bits and light emission period 212 corresponding to the odd-numbered data bits in the one-frame period.

By providing foregoing light emission forced-stop period 215 within the one-frame period, a scanning time ts# in each pixel row is set to or below a time obtained by dividing a sum of program period 200 and light emission period 210 in period 1 by the number (i.e., L) of the pixel rows. Thus, scanning time ts# can be longer than scanning time ts in FIG. 8. Thereby, the drive circuit portion of the panel, which is represented as peripheral circuits of pixel array. 102 according to this embodiment, can reduce power consumption under the same conditions in connection with the one-frame period.

Description will now be given on the structure for achieving light emission forced-stop period 215.

Figure 11:
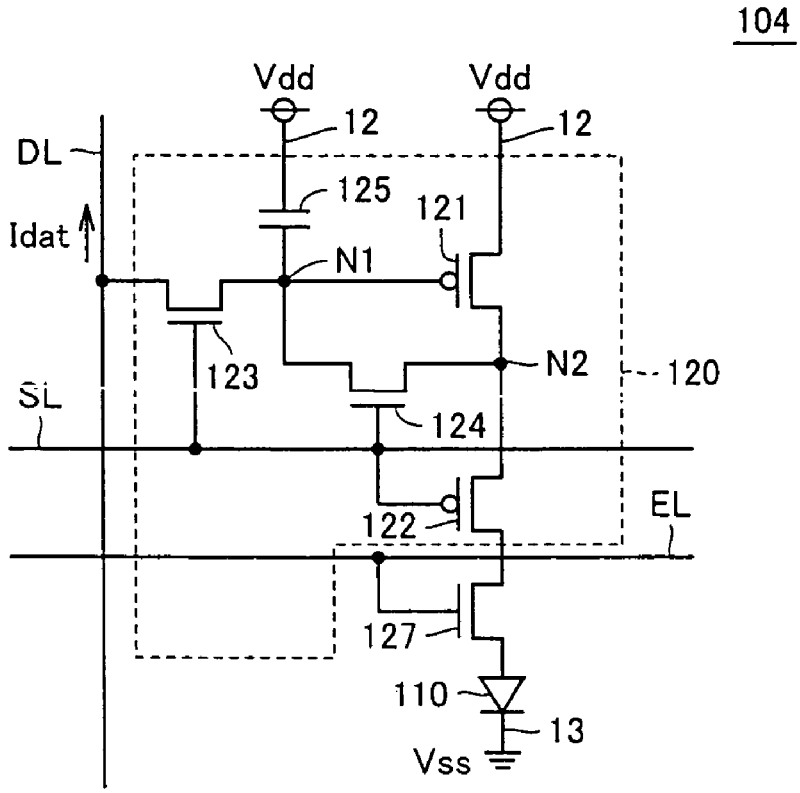
FIG. 11 is a circuit diagram illustrating a structure of the pixel shown in FIG. 9.

FIG. 11 is a circuit diagram showing a structure of pixel 104 shown in FIG. 9.

Referring to FIG. 11, pixel 104 differs from pixel 100 shown in FIG. 7 in that pixel 104 further includes an n-type TFT 127 provided as a switch element for controlling conduction and interruption of the current supply path from pixel drive circuit 120 to light-emitting element 110 of the current drive type. n-type TFT 127 is connected in series to p-type TFT 122 and between p-type TFT 121 and light-emitting element 110 of the current drive type, and has a gate connected to corresponding stop scan line EL.

Therefore, n-type TFT 127 is turned on when corresponding stop scan line EL is set to the H-level, and is turned off when it is set to the L-level. A similar function may be achieved by arranging n-type TFT 127 between p-type TFT 122 and node N2.

Figure 12:
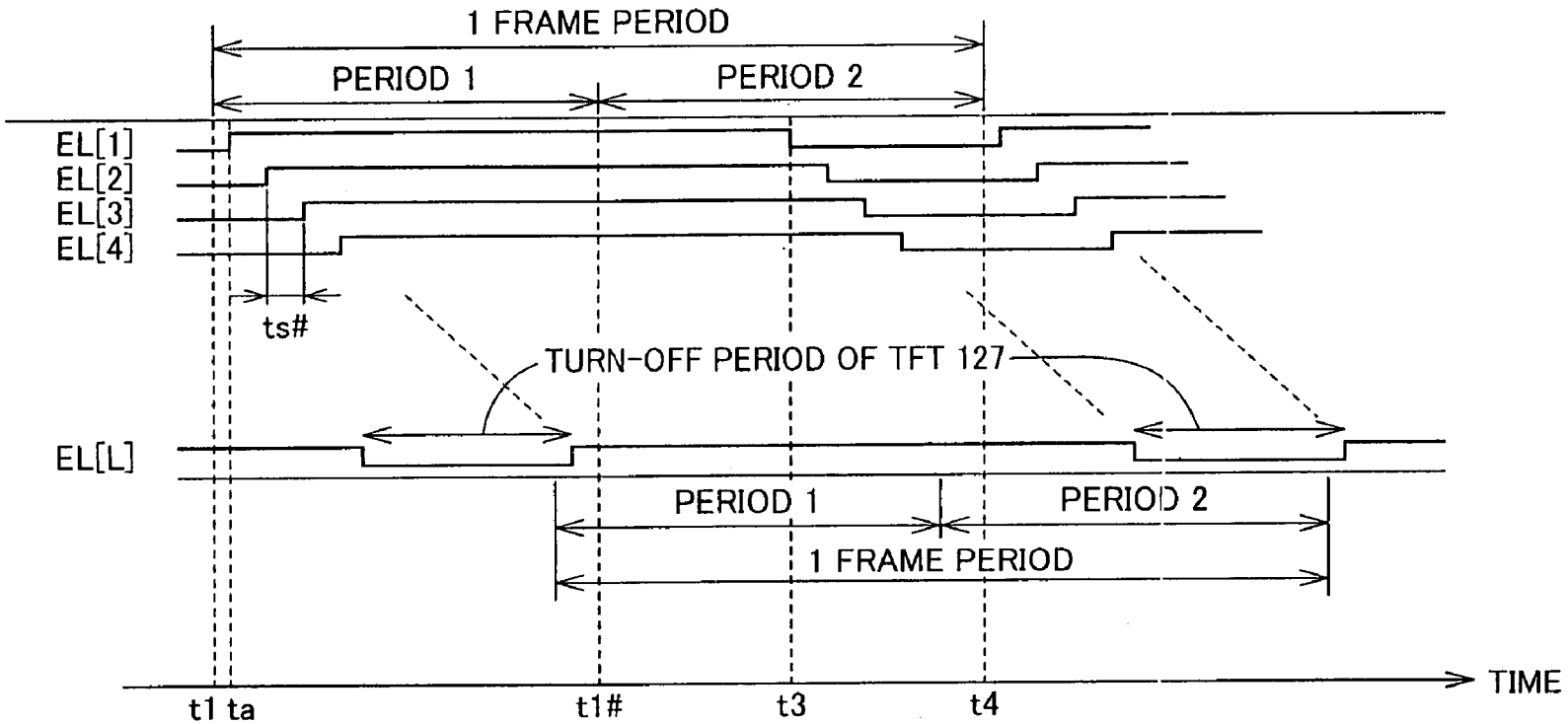
FIG. 12 illustrates an operation of a stop scan circuit shown in FIG. 9.

FIG. 12 illustrates an operation of stop scan circuit 180 shown in FIG. 9.

Referring to FIG. 12, stop scan circuit 180 controls the voltage levels of stop scan lines EL[1]-EL[L] based on scanning time ts#. In each pixel row, stop scan line EL (generally representing stop scan line(s) EL[1]-EL[L]]) is set to the L-level for turning off n-type TFT 127 in light emission stop period 215 (FIG. 10). Conversely, stop scan line EL must be set to the H-level for supplying a current to light-emitting element 110 of the current drive type during at least light emission periods 210 and 212 (FIG. 10).

During program periods 200 and 202 (FIG. 10), p-type TFT 122 connected in series to n-type TFT 127 is turned off in response to the selection (H-level) of corresponding scan line SL so that stop scan line EL can be set to either of the H- and L-levels.

For example, stop scan line EL[1] corresponding to the first row is therefore set to the H-level during a period from a time ta in period 1 corresponding to the end timing of program period 200 to time t3 in period 2 corresponding to the end timing of light emission period 212, and is set to the L-level after time t3. During a period between times t3 and t4, i.e., during light emission stop period 215, n-type TFT 127 is turned off to stop the supply of current to light-emitting element 110 of the current drive type. For the second to Lth (last) rows, the voltage levels of stop scan lines EL[2]-EL[L] are successively set in accordance with timing shifted by scan time ts#.

Thereby, light emission of light-emitting element 110 of the current drive type in light emission stop period 215 stops in each pixel row so that driving of the pixel illustrated in FIG. 10 is achieved. As described above, the image display device according to the third embodiment can achieve the same effects as those achieved by the second embodiment, and further can reduce the power consumption of the drive circuit portion of the panel by increasing the scanning time.

Modification of Third Embodiment

A modification of the third embodiment will now be described in connection with another structure example, which can achieve light emission forced-stop period 215 similarly to the third embodiment.

Figure 13:
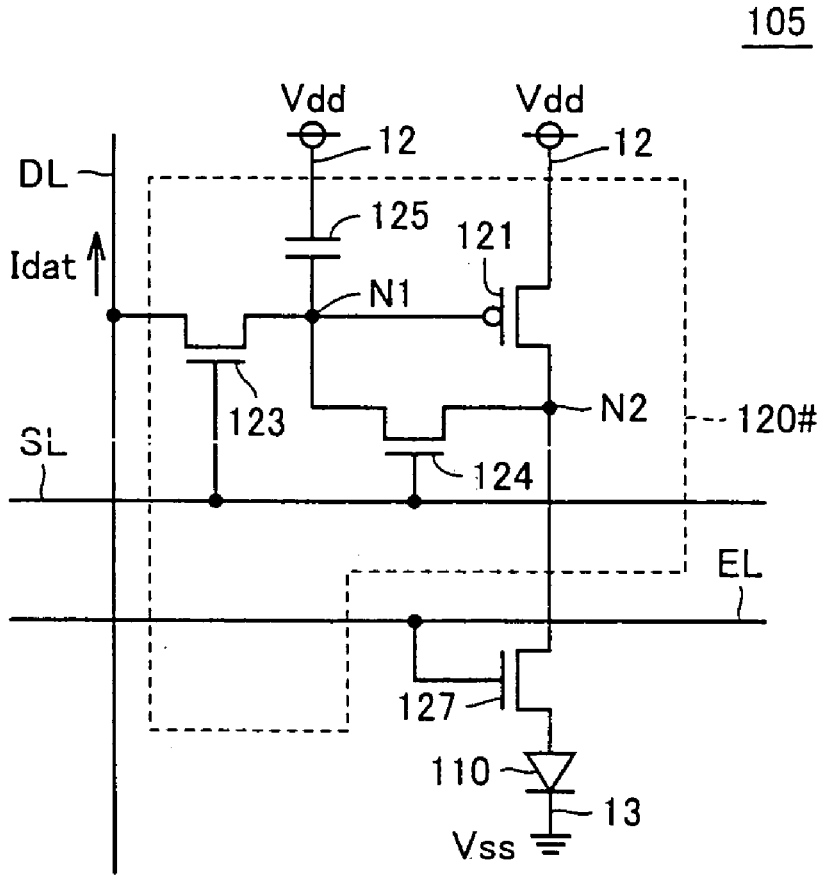
FIG. 13 is a circuit diagram showing a structure of a pixel in a modification of the third embodiment.

Referring to FIG. 13, a pixel 105 according to the modification of the third embodiment differs from pixel 104 (FIG. 11) according to the third embodiment in that pixel drive circuit 120 in FIG. 11 is replaced with a pixel drive circuit 120#. Pixel drive circuit 120# is not provided with p-type TFT 122 provided in pixel drive circuit 120.

Accordingly, connection and disconnection between the current drive element, i.e., p-type TFT 121 and light-emitting element 110 of the current drive type are controlled only by n-type TFT 127, which is turned on/off in response to stop scan line EL. Thereby, stop scan circuit 180 controls each stop scan line EL in a manner different from that in the third embodiment.

Figure 14:
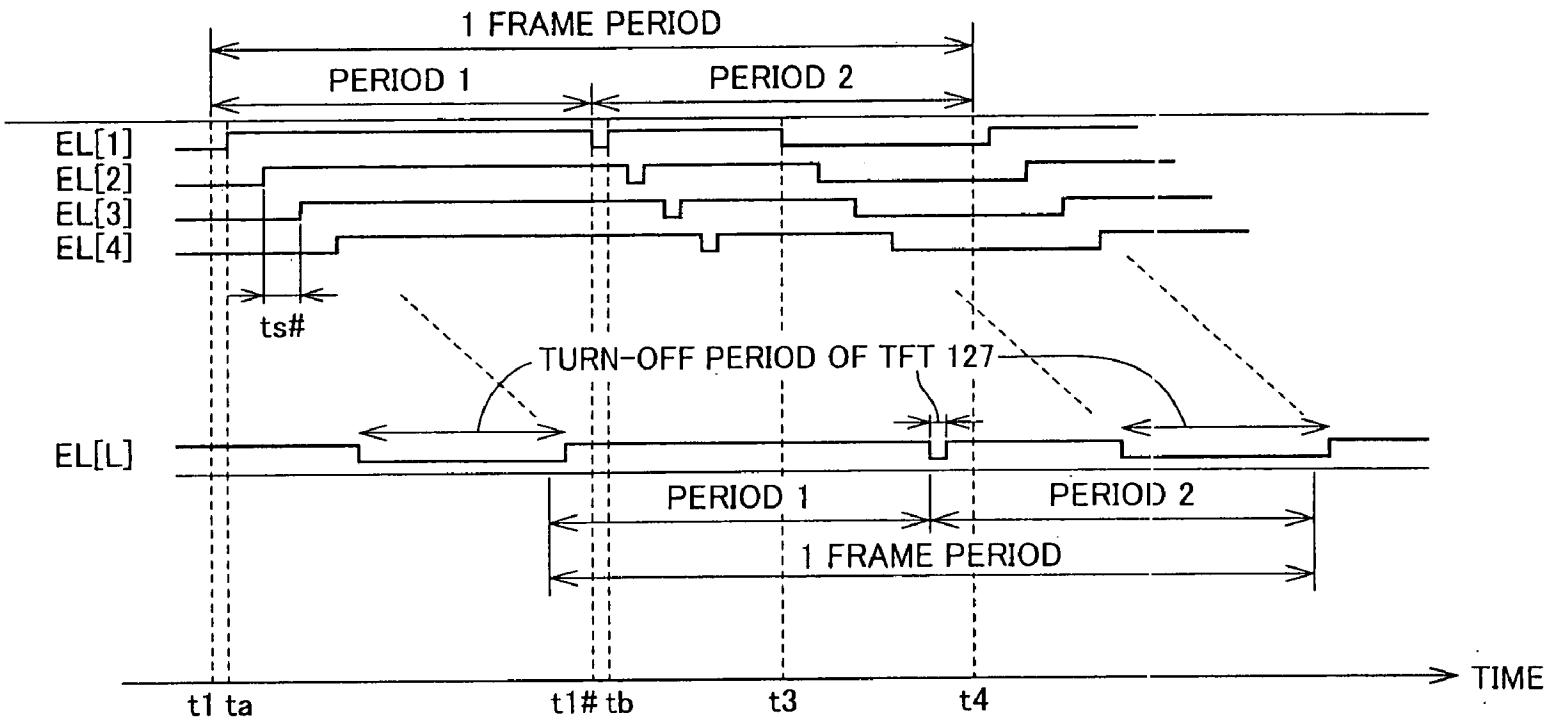
FIG. 14 illustrates an operation of the stop scan circuit in the modification of the third embodiment.

FIG. 14 illustrates an operation of the stop scan circuit in the modification of the third embodiment.

According to the structure of the modification of the third embodiment, as illustrated in FIG. 14, it is necessary to turn off n-type TFT 127 during program periods 200 and 202 illustrated in FIG. 10. For example, stop scan line EL[1] corresponding to the first row is therefore set to the L-level during periods between times t1 and ta, and between times t1# and tb corresponding to program periods 200 and 202, respectively. For the 2nd to Lth rows, the voltage levels of scan lines EL[2] in to ET[L] are successively set in a similar manner according to the timing shifted by scan time ts#.

The pixel according to the modification of the third embodiment requires the TFT elements fewer by one than those in the pixel according to the third embodiment, and therefore can be manufactured at a lower cost. Since the area of the pixel drive circuit per pixel is reduced, it is possible to increase the resolution of the display.

In the pixel structures shown in FIGS. 11 and 13, n-type TFT 127 may be replaced with a p-type TFT, and the voltage level of stop scan line EL may be inverted from that illustrated in FIGS. 12 and 14.

In the first to third embodiments and the modification, period 1 for supplying the gray-scale current corresponding to the even-numbered bits precedes the period for supplying the gray-scale current corresponding to the odd-numbered bits. However, the order of periods 1 and 2 may be inverted.

The number of bits of the image data is not restricted to eight, and the structures according to the first to third embodiments can be applied to image signals of any number of bits.

In particular, even in the case where the image data is formed of odd bits corresponding to the required number of gray-levels, a most significant bit, which is a dummy bit always set to "0" independently of the display brightness, may be added so that the first to third embodiments can be applied to such image data.

The structures of pixels in the second and third embodiments and the modification have been described merely by way of example, and the invention can be applied to image display devices provided with pixels, which have circuit structures achieving similar functions. In particular, a pixel may have such a structure that a current according to a gray-scale current to be programmed is supplied to a light-emitting element of the current drive type during a program period in parallel with programming of the gray-scale current to a pixel drive current, and the invention can be applied to the above pixel structure by paying attention to a ratio between light emission periods of the light-emitting element or the current drive type.

The first to third embodiments and the modification have been described in connection with the examples of the structure, in which gray-scale current Idat is supplied in the direction flowing from the pixel to the gray-scale current generating circuit (current supply circuit). However, the invention can be applied to a structure, in which polarities of TFTs and power supply nodes in the pixel and constant current supplies are appropriately inverted to supply gray-scale current Idat in the direction flowing from the gray-scale current generating circuit (current supply circuit) to the pixel. Thus, the invention can be commonly applied to image display devices having the light-emitting elements of the current drive type without particular restrictions on the structures of pixels and constant current supplies.

Fourth Embodiment

In the first to third embodiments, data bits forming the image data are divided into a group of odd-numbered data bits and a group of even-numbered data bits, and the display corresponding to the odd-numbered data bit and the display corresponding to the even-numbered data bit are performed in two periods within the one-frame period, respectively, so that the drive circuit portion of the gray-scale current is reduced in size.

The above manner may be expanded for such a case that the one-frame period is divided into three or more periods. In the fourth embodiment described below, the one-frame period is divided into K (K: integer larger than one), and image data of bits of N (N: integer equal to (M×K) and larger than three) in total number is divided into M (M: integer larger than one) bit groups each including K bits for image display. In the case of (K=2) has already been described in the first to third embodiments.

In the example described below, K is equal to three.

Referring to FIG. 15, in the case of K=3, data bits D(1)-D(N) forming the image data of N bits is divided into bit groups of M in number each including three bits (K bits). Bit-weighted currents corresponding to data bits D(1)-D(N) are indicated by I1-I2$^{(N-1)}$, respectively.

Similarly to the first to third embodiments, constant current supplies CS are provided for the bit groups, respectively, and current control for the mth (m: integer from 1 to M) bit group is performed as illustrated in FIG. 16.

Referring to FIG. 16, the one-frame period is divided into three periods 1-3 corresponding to K (=3), and the current supply operation during each period is controlled in accordance with data bit D(3m), D(3m−1) or D(3m−2). Thus, the supply of output current I(m) during period 1 is executed or stopped according to data bit D(3m). Also, the supply of output current I(m) during periods 2 and 3 are executed or stopped according to data bits D(3m−1) and D(3m−2), respectively.

Light emission time lengths, i.e., lengths of time periods of current supply to light-emitting element 110 of the current drive type during the periods 1, 2 and 3 are set to satisfy a relationship of (4T:2T:T=4:2:1). Thereby, in accordance with eight combinations ((D(3m), D(3m−1), D(3m−2)=(0, 0, 0)-(1, 1, 1)) of three data bits, current-time product S(m) of the current supplied to light-emitting element 110 of the current drive type can be selectively set to eight values, which are larger by zero to seven times than I(m)·T, respectively. Thus, the single constant current supply can set the current-time product in a stepwise fashion for the three bits.

Similarly to the first to third embodiments, similar structures are provided for the respective bit groups, and a sum of the output currents supplied selectively from the respective constant current supplies is supplied to the current drive element. Also, the output currents of the respective current supplies are set in accordance with a ratio of powers of $2^K$ as illustrated in FIG. 15. Thus, relationships of (I(1)=I1) and (I(m)=I(m−1)·$2^K$) are set.

The drive circuit portion of the gray-scale current is provided with the constant current supplies, switching elements and signal lines, which are equal in number to the number of bit groups, i.e., N/K (N: the number of bits of image data), and thereby, the current-time product of the light-emitting element 110 of the current drive type in each pixel can be controlled in accordance with the N-bit gray-scales according to the above setting.

If the number of bits of the image data corresponding to the number of required gray-scales is not equal to an integral multiple of K, a dummy bit, which is always set to "0" regardless of the display brightness (luminance), is added as the most significant bit so that the data bits forming the image data can be divided into the M bit groups each having K bits. In the case of (K≧3), the order of K periods included in the same one-frame period may be appropriately changed.

As described above, the one-frame period may be divided into three or more when necessary, and the invention can be applied thereto without restrictions on the number of bits of the image data, and the drive circuit portion of the gray-scale current can be significantly reduced in size. Thereby, the image display device can be further reduced in size and manufacturing cost.

The image display device and the image display method according to the invention can be applied, e.g., to the display panel provided with the light-emitting elements of the current drive type such as organic EL elements.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image display device for gray-scale expression based on a digital signal of weighted N bits (where N is an even integer larger than three), the image display device comprising:

a plurality of pixels arranged in rows and columns;

a scanning portion for periodically selecting said pixels in a predetermined manner; and a gray-scale current generating circuit supplying a gray-scale current according to the digital signal to at least one of said pixels selected by said scanning portion, wherein each of said pixels includes:

a light-emitting element exhibiting brightness according to a supplied current, and a pixel drive circuit for supplying the current to said light-emitting element, said pixel drive circuit receives the gray-scale current from said gray-scale current generating circuit during a predetermined period selected by said scanning portion, and supplies a current, according to the gray-scale current received during the predetermined period, to said light-emitting element, said gray-scale current generating circuit includes:

a bit select circuit receiving the digital signal, and selectively providing one of two sets of (N/2) bits respectively including even-numbered bits and odd-numbered bits among the N bits, and a current supply circuit controlling the gray-scale current at $2^{(N/2)}$ levels according to the (N/2) bits provided from said bit select circuit, in each of said pixels, said light-emitting element receives a current according to the gray-scale current according to one of the two sets of (N/2) bits for a first time length, and then receives a current according to the gray-scale current according to the other of the two sets of (N/2) bits for a second time length, and one of the first and second time lengths is twice as long as the other of the first and second time lengths, in accordance with weighting of the digital signal.

2. The image display device according to claim 1, further comprising:

a data line arranged between said gray-scale current generating circuit and said plurality of pixels for transmitting the gray-scale current, wherein said current supply circuit includes:

constant current supplies, (N/2) in number, arranged corresponding to the (N/2) bits provided from said bit select circuit, respectively, switch elements, (N/2) in number, connected in parallel between said (N/2) constant current supplies and said data line, respectively, and signal lines, (N/2) in number, for transmitting the (N/2) bits provided from said bit select circuit to said (N/2) switch elements, respectively, output currents of said (N/2) constant current supplies are set in a stepwise fashion in accordance with a ratio between powers of four, and each of said (N/2) switch elements transmits the output current of a corresponding one of said (N/2) constant current supplies to said data line in accordance with the corresponding one bit among the (N/2) bits.

3. The image display device according to claim 1, wherein a one-frame period in each of said pixels is divided into first and second periods, the first period includes a first program period and a first light emission period, each of said pixels is selected by said scanning portion during the first program period, receives the gray-scale current according to the set of (N/2) bits including one of the even-numbered bits and the odd-numbered bits during the first program period, and supplies a current according to the gray-scale current supplied during the first program period to said light-emitting element during said first light emission period, the second period includes a second program period and a second light emission period, each of said pixels is selected by said scanning portion during the second program period, receives the gray-scale current according to the set of (N/2) bits including the other of the even-numbered bits and the odd-numbered bits during the second program period, and supplies a current according to the gray-scale current supplied during the second program period to said light-emitting element during the second light emission period, the second program period starts after the first light emission period of the first time length, and the next one-frame period starts after the second light emission period of the second time length.

4. The image display device according to claim 3, wherein said scanning portion selects said pixels row by row, and the one-frame period and the first and second periods are set on a row-by-row basis.

5. The image display device according to claim 1, wherein a one-frame period in each of said pixels is divided into first and second periods, the first period includes a first program period and a first light emission period, each of said pixels is selected by said scanning portion during the first program period, receives the gray-scale current according to the set of (N/2) bits including one of the even-numbered bits and the odd-numbered bits during the first program period, and supplies a current according to the gray-scale current supplied during the first program period to said light-emitting element during the first light emission period of the first time length, the second period includes a second program period and a second light emission period, each of said pixels is selected by said scanning portion during the second program period, receives the gray-scale current according to the set of (N/2) bits including the other of the even-numbered bits and the odd-numbered bits during the second program period, and supplies a current according to the gray-scale current supplied during the second program period to said light-emitting element during the second light emission period of the second time length, at least one of the first and second periods further includes a light emission stop period, and supply of a current to said light-emitting element stops during the light emission stop period.

6. The image display device according to claim 5, further comprising a stop scan portion periodically selecting said plurality of pixels in a predetermined manner, and forcedly stopping light emission of said light-emitting element in the selected pixel, wherein each of said pixels further includes a switch element controlling conduction and interruption of a current supply path from said pixel drive circuit to said light-emitting element in response to an instruction from said stop scan portion.

7. The image display device according to claim 5, wherein said scanning portion selects said pixels row by row, and the one-frame period and the first and second periods are set on a row-by-row basis.

8. The image display device according to claim 1, wherein the digital signal includes a dummy bit always set to a predetermined level.

9. The image display device according to claim 1, wherein said light-emitting element is an organic light-emitting element.

10. An image display device for gray-scale expression based on a digital signal of weighted N bits (where N is an integer exceeding three and represented by (K×M) where K and M are both integers larger than one), comprising:

a plurality of pixels arranged in rows and columns;

a scanning portion for periodically selecting said pixels in a predetermined manner; and a gray-scale current generating circuit supplying a gray-scale current according to the digital signal to at least one of said pixels selected by said scanning portion, wherein each of said pixels includes:

a light-emitting element exhibiting brightness according to a supplied current, and a pixel drive circuit for supplying the current to said light-emitting element, said pixel drive circuit receives the gray-scale current from said gray-scale current generating circuit during a predetermined period selected by said scanning portion, and supplies a current according to the gray-scale current received during the predetermined period to said light-emitting element, the N bits are divided, in an order of weighting of the digital signal, into bit groups M in number, each group including K bits, said gray-scale current generating circuit includes:

a bit select circuit receiving the digital signal, and successively providing, set by set, K sets of M-bit data, each set including one bit among K bits included in each of said M bit groups, and a current supply circuit controlling the gray-scale current at $2^M$ levels according to the M-bit data provided from said bit select circuit, in each of said pixels, said light-emitting element receives currents corresponding to the gray-scale currents corresponding to the K sets of M-bit data during first to Kth time lengths independent from each other, respectively, and the first to Kth time lengths are set according to the weighting of the digital signal and in accordance with powers of 2.

11. The image display device according to claim 10, wherein the digital signal includes a dummy bit always set to a predetermined level.

12. The image display device according to claim 10, wherein said light-emitting element is an organic light-emitting element.

13. An image display method of gray-scale expression based on a digital signal of weighted N bits (where N is an even integer larger than three) by an image display device at each of pixels with a light-emitting element exhibiting brightness corresponding to a supplied current, wherein a one-frame period of each of said pixels is divided into first and second periods, in each of said pixels, said light-emitting element receives a current according to a gray-scale current according to one of two sets of (N/2) bits respectively including even-numbered bits and odd-numbered bits of the digital signal for a first time length during said first period, and then receives a current according to the gray-scale current according to the other of the two sets of (N/2) bits for a second time length during the second period, during each of the first and second periods, control of the gray-scale current according to each of said two sets of (N/2) bits is performed in the same manner, and one of the first and second time lengths is twice as long as the other of the first and second time lengths in accordance with weighting of the digital signal.

14. The image display method according to claim 13, wherein the gray-scale current is supplied as a sum of output currents provided from constant current supplies selected in accordance with the set of (N/2) bits among the (N/2) constant current supplies, and output currents of said (N/2) constant current supplies are set in a stepwise fashion in accordance with ratios of powers of four.

15. The image display method according to claim 13, wherein the digital signal includes a dummy bit always set to a predetermined level.

16. An image display method of gray-scale expression based on a digital signal of weighted N bits (where N is an integer exceeding three and represented by (K×M) where K and M are both integers larger than one), by an image display device provided at each of pixels with a light-emitting element exhibiting brightness corresponding to a supplied current, wherein a one-frame period in each of said pixels is divided into first to Kth periods, the N bits is divided, in an order of weighting of the digital signal, into bit groups, M in number, each group including K bits, said light-emitting element in each of said pixels receives currents corresponding to a gray-scale current corresponding to one of K sets of M bits including one bit successively selected from the K bits included in each of the bit groups, M in number, for first to Kth independent time lengths in the first to Kth time lengths, respectively, during each of said the first to Kth periods, control of the gray-scale current according to the M bits is performed in the same manner, and the first to Kth time lengths are set in accordance with powers of 2 according to the weighting of the digital signal.

17. The image display method according to claim 16, wherein the gray-scale current is supplied as a sum of output currents from constant current supplies selected in accordance with the M bits among the M constant current supplies, and output currents of the M constant current supplies are set in a stepwise fashion in accordance with ratios of powers of $2^K$.

18. The image display method according to claim 16, wherein the digital signal includes a dummy bit always set to a predetermined level.

* * * * *